US007978022B2

(12) United States Patent
Seong et al.

(10) Patent No.: US 7,978,022 B2
(45) Date of Patent: Jul. 12, 2011

(54) CABLE TO WAVEGUIDE TRANSITION APPARATUS HAVING SIGNAL ACCUMULATION FORM OF BACKSHORT AND ACTIVE PHASE SHIFTING USING THE SAME

(75) Inventors: Nak-Seon Seong, Daejon (KR); Won-Kyu Choi, Gyeonggi-do (KR); Ji-Hoon Bae, Daejon (KR); Jong-Moon Lee, Chungcheongbuk-do (KR); Cheol-Sig Pyo, Daejon (KR); Chang-Joo Kim, Daejon (KR)

(73) Assignee: Electronics and Telecommunications Research Institute (KR)

( * ) Notice: Subject to any disclaimer, the term of this patent is extended or adjusted under 35 U.S.C. 154(b) by 630 days.

(21) Appl. No.: 11/587,068

(22) PCT Filed: Dec. 30, 2004

(86) PCT No.: PCT/KR2004/003539

§ 371 (c)(1),
(2), (4) Date: May 7, 2009

(87) PCT Pub. No.: WO2005/104295

PCT Pub. Date: Nov. 3, 2005

(65) Prior Publication Data

US 2009/0219116 A1 Sep. 3, 2009

(30) Foreign Application Priority Data

Apr. 20, 2004 (KR) ..... 10-2004-0027188
Jun. 18, 2004 (KR) ..... 10-2004-0045706

(51) Int. Cl.
*H01P 5/103* (2006.01)

(52) U.S. Cl. ..... 333/26; 333/254

(58) Field of Classification Search ..... 333/254, 333/260, 26, 22 R
See application file for complete search history.

(56) References Cited

U.S. PATENT DOCUMENTS 4,672,388 A 6/1987 Grim
6,549,106 B2 4/2003 Martin

FOREIGN PATENT DOCUMENTS

JP 53-49949 4/1978
JP 10-041716 A 2/1998
KR 1992-0002772 10/1990
KR 1997-18833 B1 4/1997

OTHER PUBLICATIONS

R.B. Keam et al., Broadband design of coaxial line/rectangular waveguide probe transition, IEE Proceedings—Microwave Antennas Propagation, vol. 141, No. 1, pp. 53-57, Feb. 1994.

*Primary Examiner* — Stephen E Jones
(74) *Attorney, Agent, or Firm* — Blakely, Sokoloff, Taylor & Zafman

(57) ABSTRACT

A cable to waveguide transition apparatus having a signal accumulation form of a backshort is disclosed. The cable to waveguide transition apparatus having a signal accumulation form of a backshort, includes: a waveguide; a RF probe for transferring a radio frequency (RF) signal to the waveguide; and a backshort having the signal accumulation form for reflecting the RF signal excited from the RF probe, wherein the backshort reflects a first fundamental frequency signal excited from the RF probe to have a phase identical to a phase of a second fundamental frequency signal excited from the RF probe to an aperture of the waveguide, and reflects a first 2-order harmonic frequency signal excited from the RF probe to have a phase reverse to a phase of a second 2-order harmonic frequency signal excited to an aperture of the waveguide in order to eliminate the 2-order harmonic frequency signal.

7 Claims, 10 Drawing Sheets

CABLE TO WAVEGUIDE TRANSITION APPARATUS HAVING SIGNAL ACCUMULATION FORM OF BACKSHORT AND ACTIVE PHASE SHIFTING USING THE SAME

TECHNICAL FIELD

The present invention relates to a cable to waveguide transition apparatus having a signal accumulation form of a backshort and an active phase shifting system using the same; and, more particularly, to a cable to waveguide signal transition apparatus for reducing a distance between the backshort to a probe of the cable and eliminating 2-order harmonic frequency excited from the cable by designing the backshort in the waveguide to be the signal accumulation form, and an active phase shifting system using the same.

BACKGROUND ARTS

Hereinafter, a conventional cable to waveguide transition apparatus is explained by using a coaxial cable to rectangular waveguide transition apparatus as an example of the conventional cable to waveguide transition apparatus.

FIG. 1 is a diagram illustrating a conventional cable to waveguide transition apparatus having a plane form of a backshort.

As showing, the conventional cable to waveguide transition apparatus includes a waveguide 101. The waveguide 101 further includes a backshort 102 made by a metallic conductor having a ground plane form. The backshort 102 is a predetermined distance d away from an RF probe 104 of a coaxial cable 103, where d is $\lambda_g/4$ and $\lambda_g$ is one waveguide wavelength distance.

FIG. 2 is a cross sectional view taken along line A-A' of the conventional cable to waveguide transition apparatus of FIG. 1 and FIG. 3 is a cross sectional view taken along line B-B' of the conventional cable to waveguide transition apparatus of FIG. 1. FIGS. 2 and 3 show the waveguide 101, the backshort 102 and a location of the RF probe 104 in detail.

FIG. 4 is a diagram showing a signal path of a fundamental frequency signal of the waveguide 101 of FIG. 1 and the FIG. 5 is a diagram showing a signal path of a 2-order harmonic frequency of the waveguide 101 of FIG. 1.

As shown in FIG. 4, in case of TE10 basic mode, the fundamental frequency signal excited from the RF probe 104 to the backshort 102 is firstly reflected at the backshort 102 and then secondly reflected at a waveguide wall 109. The secondly reflected fundamental frequency signal is propagated through a wave front D which is identical to a wave front 403 of a fundamental frequency signal 402 excited from the RF probe 104 to an aperture of the waveguide 101. The secondly reflected fundamental frequency signal 404 has a phase identical to a phase of the excited fundamental frequency signal 402 at the wave front D and is propagated to the aperture of the waveguide 101 without reduction of signal. That is, the secondly reflected fundamental frequency signal 404 has same phase comparing to a phase of the excited fundament frequency signal 402 at the wave front D.

As shown in FIG. 5, the 2-order harmonic frequency signal 505 excited from the RF probe 104 to the backshort 102 is reflected at the backshort 102 and then the reflected harmonic frequency signal is propagated to the aperture of the waveguide 101. The reflected harmonic frequency signal 501 is propagated through a wave front Q which is identical to a wave front 504 of a 2-order harmonic frequency signal 503 excited from the RF probe 104 to an aperture of the waveguide 101. However, a phase of the reflected harmonic frequency signal 501 reached at the wave front Q is not identical to a phase of the excited 2-order harmonic frequency signal 503 at the wave front 504 and also, it does not generates 180° phase difference. Therefore, the reflected harmonic frequency signal 501 is propagated to the aperture of the waveguide 101 without compensation. That is, the reflected harmonic frequency signal 501 does not provide the identical phase comparing to the phase of the excited 2-order harmonic frequency signal 503 at the wave front Q and is not compensated because there is not 180° phase difference. If the reflected harmonic frequency signal 501 has the identical phase, it is propagated to the aperture of the waveguide without reduction of signal.

Therefore, if suppression of 2-order harmonic frequency signal is required, a system would be very complicated because it needs a filter having high-order harmonic frequency signal suppression characteristic.

Meanwhile, the conventional cable to waveguide transition apparatus is explained in a view of the distance d between the backshort and the probe hereinafter.

If $\lambda$ represents a wavelength of a signal, $\lambda_g$ is one wavelength of the waveguide 101 and it is expressed as:

$$\lambda_g = \frac{\lambda}{\sqrt{1-\left(\frac{\lambda}{2a}\right)^2}} \quad \text{Eq. 1}$$

As shown in Eq. 1, $\lambda_g$ is longer than $\lambda$. Therefore, d may become longer than $\lambda/4$ which is ¼ wavelength of the signal because d is $\lambda_g/4$ when the conventional cable to waveguide transition apparatus is designed according to it's designing method.

Occasionally, a length of the waveguide is physically limited and the distance d between the backshort and the RF probe must be designed to be shorter. In this case, a transmission characteristic of the fundamental frequency signal becomes degraded since the phase of the excited fundamental frequency signal 402 and the phase of the secondly reflected fundamental frequency signal 404 become different at the wave front D.

SUMMARY OF THE INVENTION

It is, therefore, an object of the present invention to provide a cable to waveguide signal transition apparatus for reducing a distance between the backshort to a probe of the cable and eliminating 2-order harmonic frequency excited from the cable by designing the backshort in the waveguide to be a signal accumulation form i.e., a cylinder form, and an active phase shifting system using the same.

In accordance with an aspect of the present invention, there is provided a cable to waveguide transition apparatus having a signal accumulation form of a backshort, including: a waveguide for propagating a signal; a RF probe of a cable for transferring a radio frequency (RF) signal to the waveguide; and a backshort of the waveguide having the signal accumulation form for reflecting the RF signal excited from the RF probe to a location of the RF probe, wherein the backshort reflects a first fundamental frequency signal excited from the RF probe to have a phase identical to a phase of a second fundamental frequency signal excited from the RF probe to an aperture of the waveguide, and reflects a first 2-order harmonic frequency signal excited from the RF probe to have a phase reverse to a phase of a second 2-order harmonic frequency signal excited from the RF probe to an aperture of the waveguide in order to eliminate the 2-order harmonic frequency signal.

In accordance with another aspect of the present invention, there is also provided an active phase shifting system, including: a controller for supplying a voltage to a radio frequency (RF) signal inputted to each port in order to make output gains of each port identical; a phase shifter for controlling a direction of beam (beam tilting) by controlling a phase of the voltage controlled RF signal according to a control signal inputted to each port; a signal combiner for combining the phase controlled RF signals; an amplifying unit for amplifying the combined signal; a filter for filtering noise of the amplified signal; and a wave guide having a signal accumulation form of a backshort reflecting a RF signal excited from a RF probe to a location of the RF probe for outputting the filtered signal, wherein the backshort reflects a first fundamental frequency signal excited from the RF probe to have a phase identical to a phase of a second fundamental frequency signal excited from the RF probe to an aperture of the waveguide, and reflects a first 2-order harmonic frequency signal excited from the RF probe to have a phase reverse to a phase of a second 2-order harmonic frequency signal excited from the RF probe to an aperture of the waveguide in order to eliminate the 2-order harmonic frequency signal.

BRIEF DESCRIPTION OF THE DRAWINGS

The above and other objects and features of the present invention will become better understood with regard to the following description of the preferred embodiments given in conjunction with the accompanying drawings, in which.

PREFERRED EMBODIMENT OF THE INVENTION

Hereinafter, a cable to waveguide transition apparatus having a signal accumulation form of a backshort and an active phase shifting system using the same in accordance with a preferred embodiment of the present invention will be described in more detail with reference to the accompanying drawings.

Figure 1:
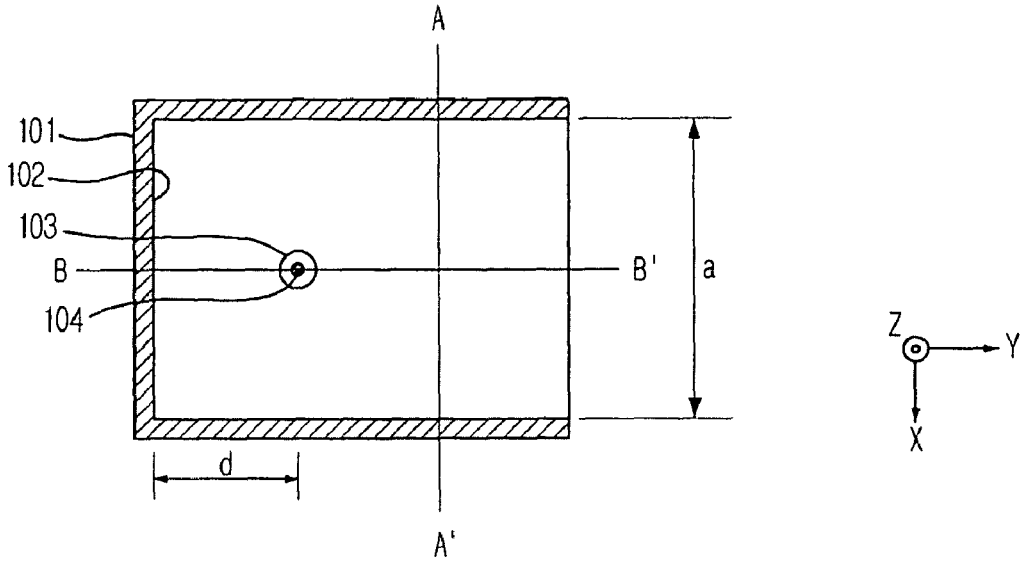
FIG. 1 (PRIOR ART)
FIG. 1 is a diagram illustrating a conventional cable to waveguide transition apparatus having a plane form of a backshort.
Figure 2:
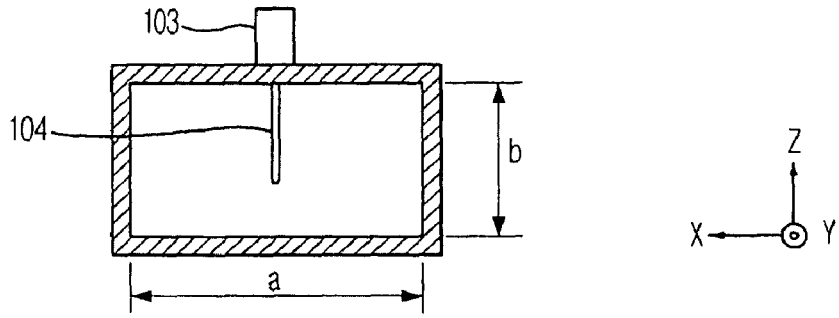
FIG. 2 (PRIOR ART)
FIG. 2 is a cross sectional view taken line with A-A' of the conventional cable to waveguide transition apparatus of FIG. 1.
Figure 3:
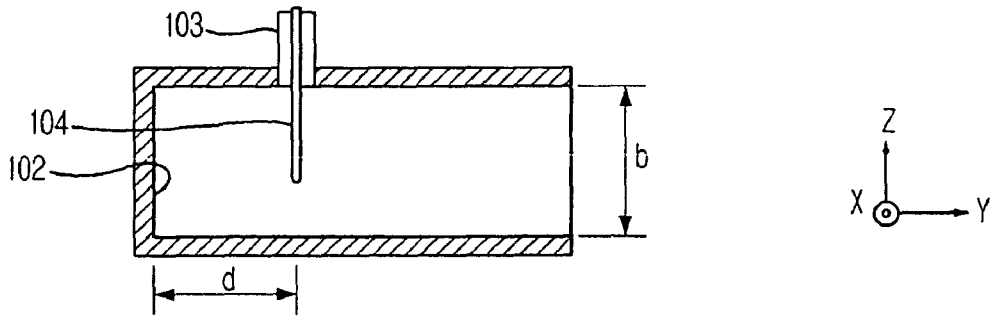
FIG. 3 (PRIOR ART)
FIG. 3 is a cross sectional view taken along line B-B' of the conventional cable to waveguide transition apparatus of FIG. 1.
Figure 4:
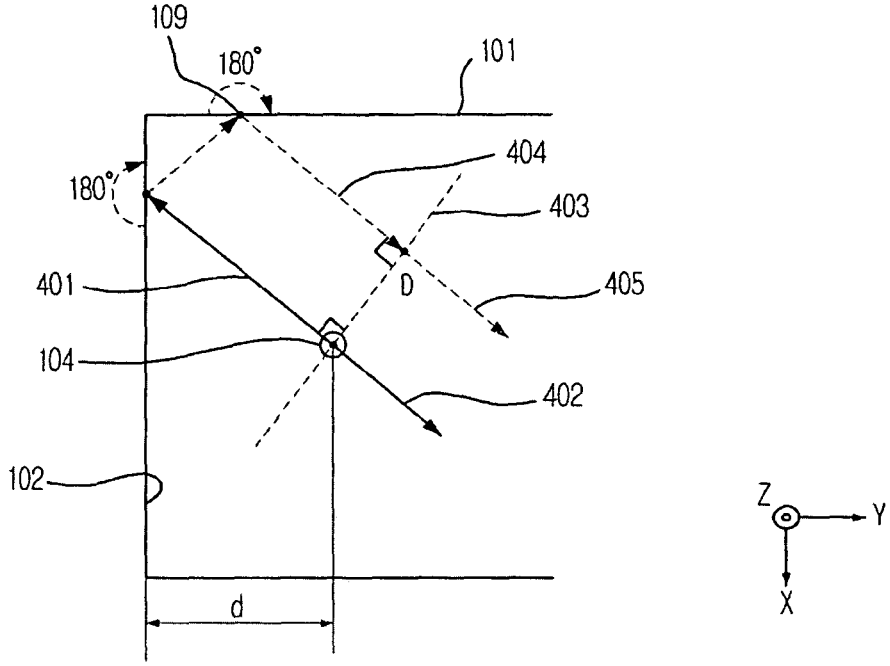
FIG. 4 (PRIOR ART)
FIG. 4 is a diagram showing a signal path of a fundamental frequency signal of the waveguide 101 of FIG. 1.
Figure 5:
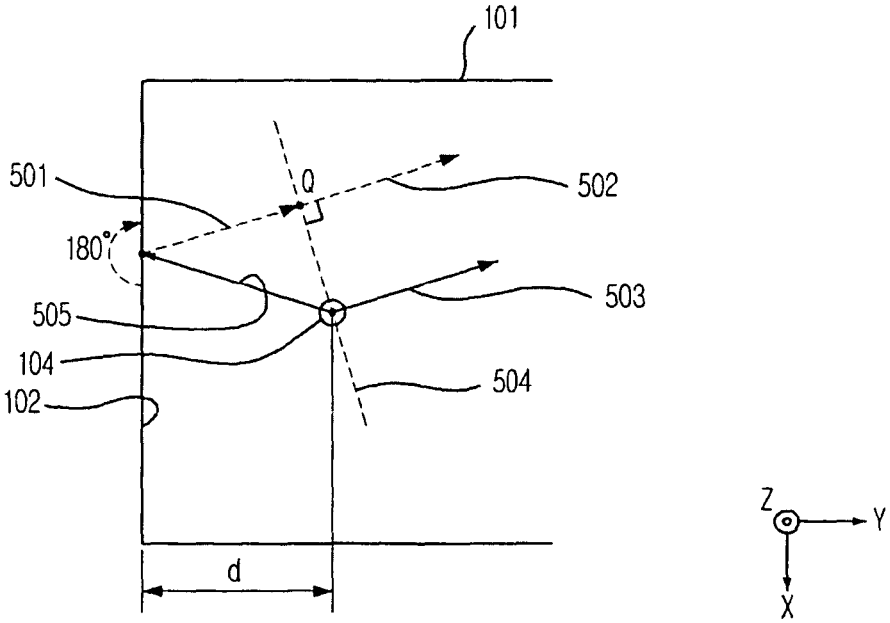
FIG. 5 (PRIOR ART)
FIG. 5 is a diagram showing a signal path of a 2-order harmonic frequency of the waveguide 101 of FIG. 1.
Figure 6:
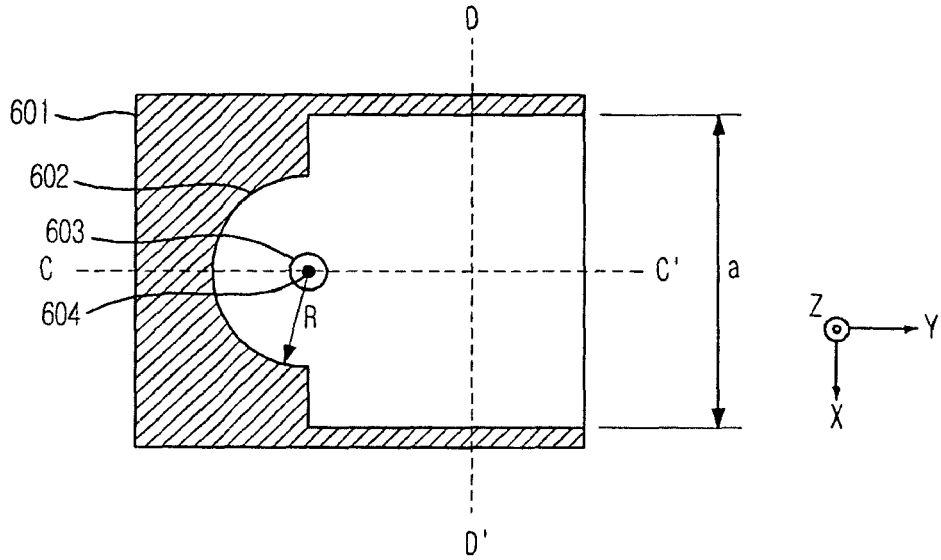
FIG. 6 is a diagram illustrating a cable to waveguide transition apparatus having a signal accumulating form in accordance with a preferred embodiment of the present invention.

FIG. 6 is a diagram illustrating a cable to waveguide transition apparatus having a signal accumulating form in accordance with a preferred embodiment of the present invention.

As shown in FIG. 6, the cable to waveguide transition apparatus includes a waveguide 601, a backshort 602 and a coaxial cable 603.

More particularly, the cable to waveguide transition apparatus in accordance with a preferred embodiment of the present invention includes the waveguide 601 for propagating a signal, a RF probe 604 of the coaxial cable 603 for transferring a radio frequency (RF) signal to the waveguide 601 and the backshort 602 having the signal accumulation form for reflecting the excited RF signal from the RF probe 604 to a RF probe location.

By the signal accumulation form of the backshort 602, a phase of a fundamental frequency signal reflected from the backshort 602 and a phase of a fundamental frequency signal excited from the RF probe 604 to an aperture of the waveguide 601 become identical. Furthermore, a phase of a 2-order harmonic frequency signal reflected from the backshort 602 becomes reverse to a phase of a 2-order harmonic frequency signal excited from the RF probe 604 to the aperture of the waveguide 601.

The waveguide 601 and the backshort 602 are implemented with a metallic material. The backshort 602 is formed as a cylinder form and the cylinder form of the backshort 602 is arranged inside of the waveguide 601.

In the preferred embodiment of the present invention, the backshort 602 is implemented to have the cylinder form. However, the form of the backshort is not limited to the cylinder form. Any forms such as a polygon reflecting the signal to a location of the probe 604 may be applicable.

Furthermore, the cable is not limited to the coaxial cable 603. Any microstrip type cables may be used as the cable.

Moreover, in the preferred embodiment of the present invention, the cylinder form of the backshore is vertically implemented but it can be horizontally implemented for providing other waveguide operation mode.

Figure 7:
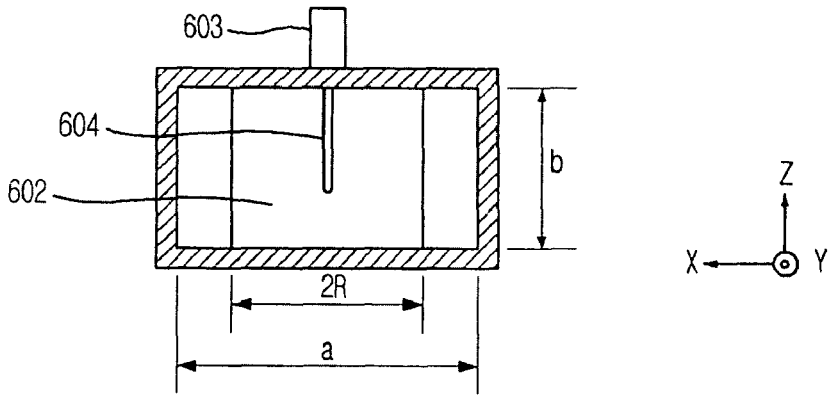
FIG. 7 is a cross sectional view taken along line C-C' of the cable to waveguide transition apparatus of FIG. 6.
Figure 8:
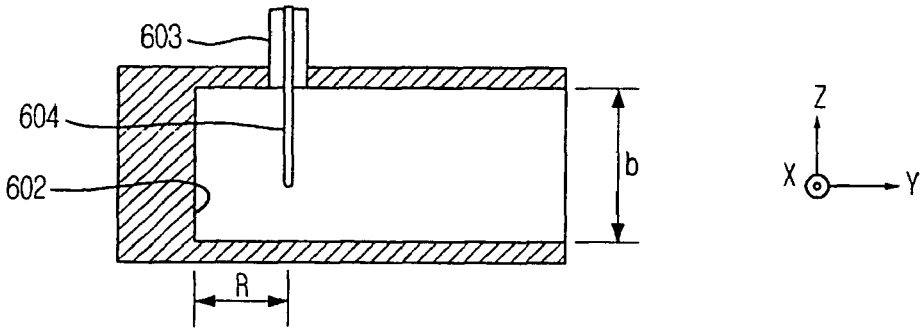
FIG. 8 is a cross sectional view taken along line D-D' of the cable to waveguide transition apparatus of FIG. 6.

FIG. 7 is a cross sectional view taken along line C-C' of the cable to waveguide transition apparatus of FIG. 6, and FIG. 8 is a cross sectional view taken along line D-D' of the cable to waveguide transition apparatus of FIG. 6.

As shown in FIGS. 7 and 8, the coaxial cable 603 is arranged on upper side of the waveguide 601 and the RF probe 604 which is a signal line of the coaxial cable 603 is inserted inside of the waveguide 601 and the inserted RF probe 604 has a predetermined length.

The RF probe 604 may be designed to have various forms and lengths by considering input impedance matching. A dielectric material may be used with the RF probe 604.

A size of the backshort 602 is designed to be λ/4 which is ¼ wavelength of the fundamental frequency signal That is, the size of the backshort 602 is a distance R between the RF probe 604 and the backshort 602. However, the size of the backshort 602 may be varied according to an application field. But, the form of the backshort must be the signal accumulating form which is a form accumulating the signal to the location of the RF probe 604. The signal accumulating form may be a cylinder form or a polygon form.

Figure 9:
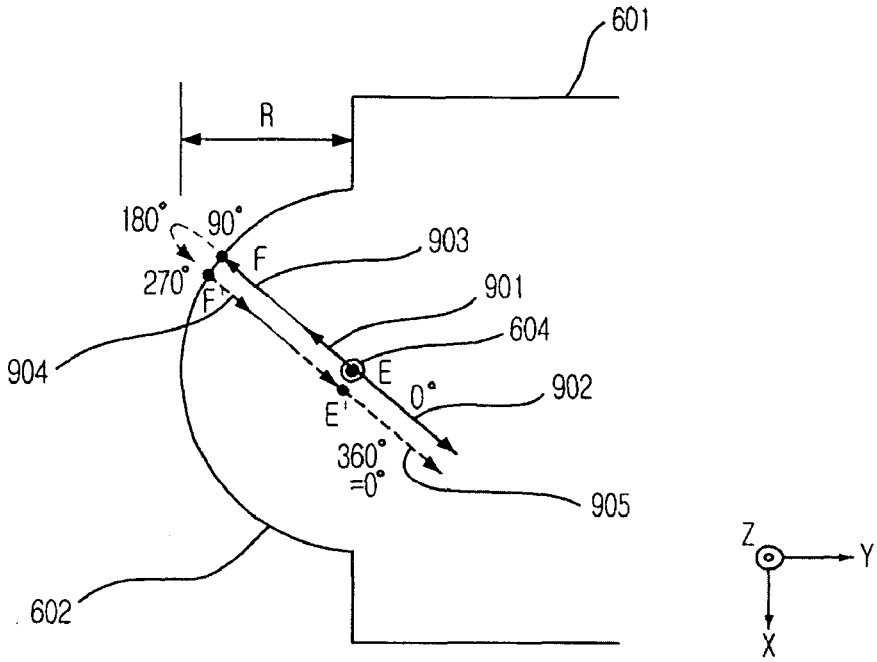
FIG. 9 is a diagram showing a signal path of a fundamental frequency signal in the waveguide 601 in FIG. 6.

FIG. 9 is a diagram showing a signal path of a fundamental frequency signal in the waveguide 601 in FIG. 6.

In the present invention, the RF probe 604 is inserted in a vertical direction of a signal propagation direction of the waveguide 601 and the RF probe 604 has a predetermined length. The RF probe 604 excites a first fundamental frequency signal 901 to the backshort 602 and also excites a second fundamental frequency signal 902 to an aperture of the waveguide 601 in $TE_{10}$ basic mode. The first fundamental frequency signal 901 is reflected from the backshort 602 and returned to the RF probe 604.

If an E field phase of the first fundamental frequency signal 901 at a location E in $TE_{10}$ is 0°, a phase of a fundamental frequency signal 903 reached at a location F of the backshort 602 has 90° difference comparing to the E field phase of the first fundamental frequency signal 901 because the first fundamental frequency signal is propagated as long as λ/4 which is ¼ wavelength of the fundament frequency signal.

A phase of a fundamental frequency signal 904 at a location F' has 180° phase difference comparing to the fundamental frequency signal 903 excited from the RF probe 604 to the back short 602. The fundamental frequency signal 904 is a reflected signal of the first fundamental frequency signal 901 which is reflected from the backshort 602.

Therefore, a phase of the fundamental frequency signal 904 reflected from the backshort 602 to the RF probe 604 has 270° phase difference comparing to the E field phase of the fundamental frequency signal 901.

When the fundamental frequency signal 904 is propagated and reached at the RF probe 604, a phase of the fundamental frequency signal 904 becomes 360° difference comparing to a phase of the second fundamental frequency signal 902 at a location E'. That is, the phase of the fundamental frequency signal 904 becomes identical to the phase of the second fundamental frequency 902 at the location E' and then the fundament frequency signal 904 is propagated to the aperture of the waveguide 601 without attenuation.

Accordingly, a distance from the RF probe 604 to the backshort 602 can be reduced according to the cable to waveguide transition apparatus in accordance with a preferred embodiment of the present invention. The distance R of the preferred embodiment of the present invention is λ/4 which is ¼ wavelength of the fundamental frequency signal. Therefore, integration of a system having the cable to waveguide transition apparatus can be increased.

Figure 10:
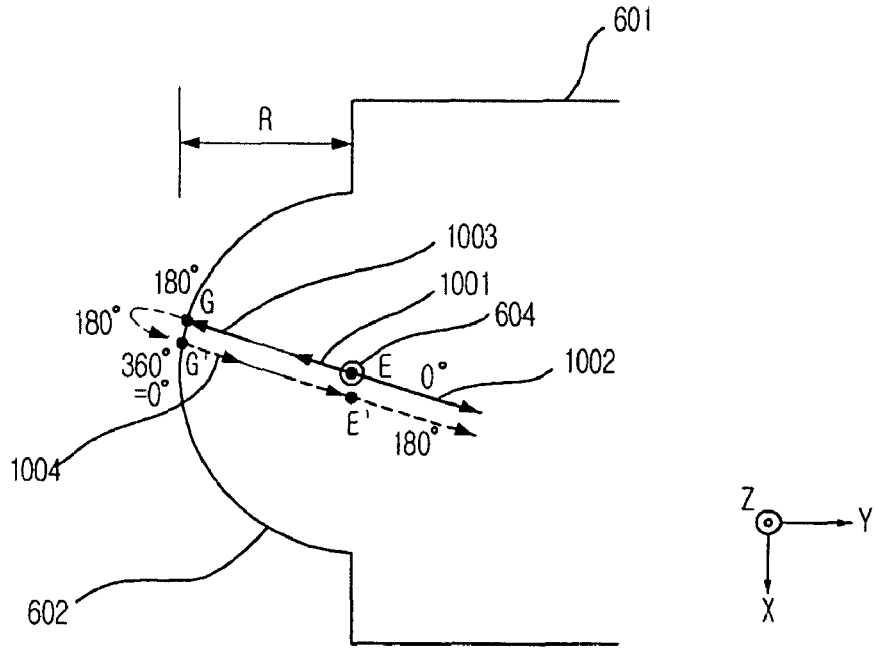
FIG. 10 is a diagram showing a signal path 2-order harmonic frequency signal of the waveguide 601 in FIG. 6.

FIG. 10 is a diagram showing a signal path 2-order harmonic frequency signal of the waveguide 601 in FIG. 6.

As shown in FIG. 10, from the RF probe 604, a first harmonic frequency signal 1001 is propagated to the backshort 602 and a second harmonic frequency signal 1002 is propagated to the aperture of the waveguide 601.

The first harmonic frequency signal 1001 is and reflected from the backshort 602 and returned to the RF probe 604. A phase variation of the first harmonic frequency signal 1001 during propagating and returning to the backshort 602 is explained hereinafter.

If a phase of the first harmonic frequency signal 1001 is 0° when it is excited from the RF probe 604, a phase of a harmonic frequency signal 1003 reached at a location G of the backshort 602 has 180° difference comparing to the phase of the first harmonic frequency signal 1001 because the first harmonic frequency signal 1001 is propagated as long as λ/2 which is ½ wavelength of the harmonic frequency signal.

The harmonic frequency signal 1003 is reflected from the location G and reached to the location G'. A phase of a harmonic frequency signal 1004 at a location G' has 180° phase difference comparing to the harmonic frequency signal 1003 at the location G.

Therefore, the phase of the harmonic frequency signal 1004 reflected from the backshort 602 to the RF probe 604 has 360° phase difference comparing to the phase of the second harmonic frequency signal 1002. That is, the phase of the harmonic frequency signal 1004 at the location G' and the phase of the second harmonic frequency signal 1002 are identical.

When the harmonic frequency signal 1004 is propagated and reached at the RF probe 604, a phase of the harmonic frequency signal 1004 becomes 180° difference comparing to a phase of the second harmonic frequency signal 1002 at a location E'. That is, the harmonic frequency signal 1004 at the location E' has reverse phase of the second harmonic frequency signal 1002. Accordingly, the 2-order harmonic frequency signal can be eliminated.

That is, the harmonic frequency signal 1004 is reached to the RF probe 604 by being propagated as long as λ/2 which is ½ wavelength of the harmonic frequency signal. Therefore, the phase of the harmonic frequency signal 1004 at the location E' becomes 180° difference to the phase of the second harmonic frequency signal 1002 and therefore, the 2-order harmonic frequency signal is cancelled.

Figure 11:
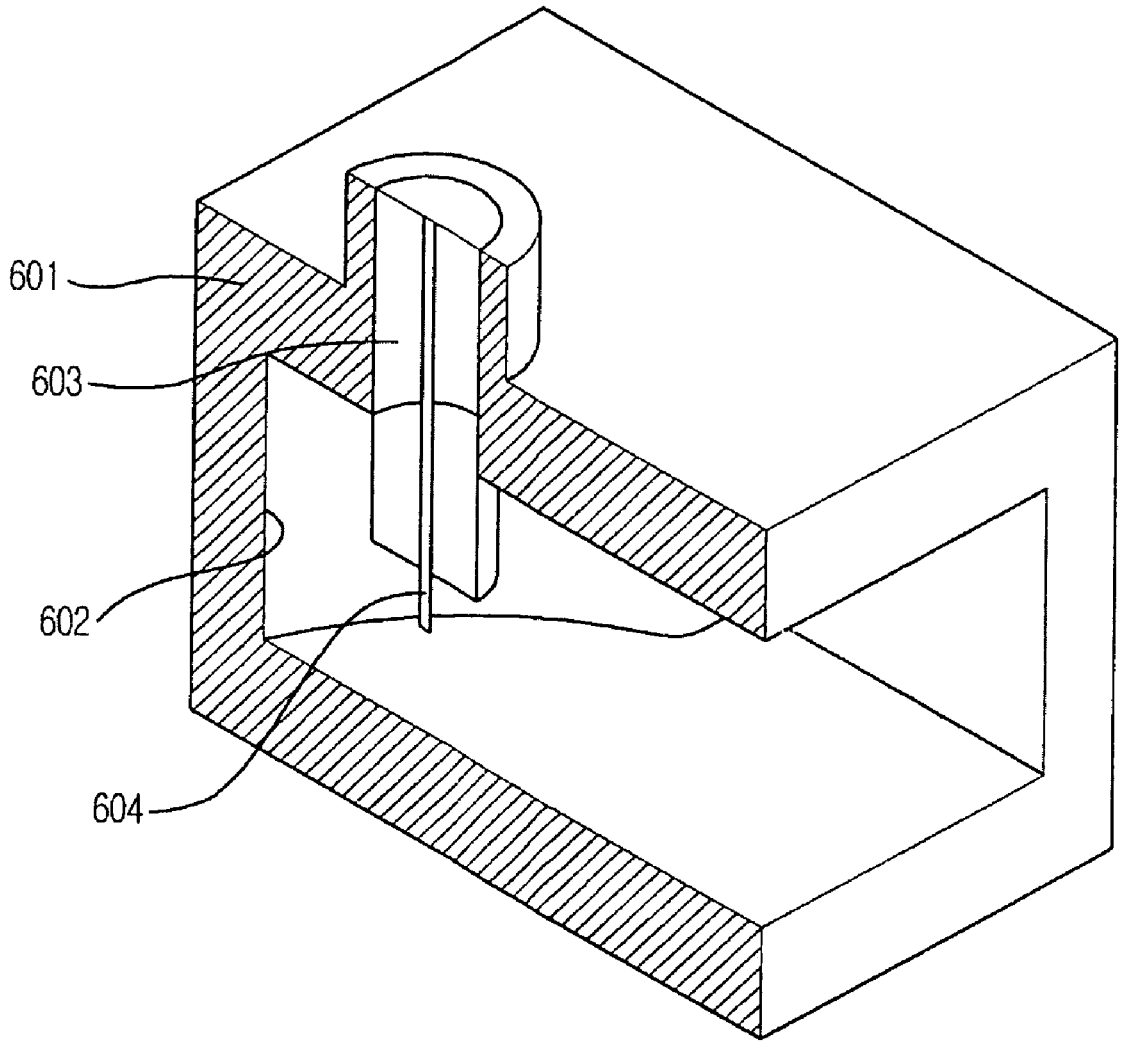
FIG. 11 is a perspective view of a cable to waveguide transition apparatus having a signal accumulation form of a backshort in accordance with a preferred embodiment of the present invention.

FIG. 11 is a perspective view of a cable to waveguide transition apparatus having a signal accumulation form of a backshort in accordance with a preferred embodiment of the present invention. And FIG. 12 is a graph showing a transfer characteristic and a reflection characteristic of a cable to waveguide transition apparatus having a signal accumulation form of a backshort in accordance with a preferred embodiment of the present invention.

Figure 12:
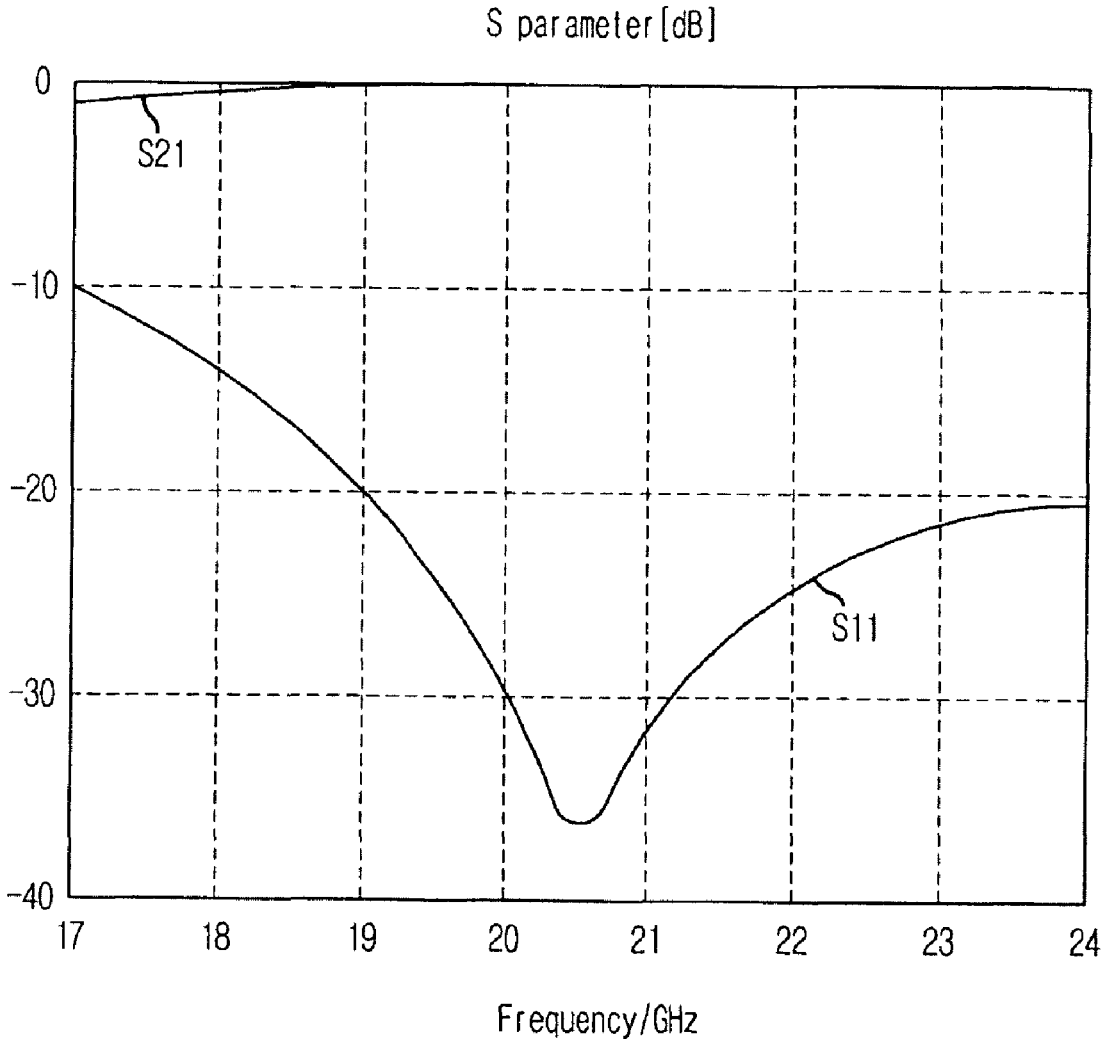
FIG. 12 is a graph showing a transfer characteristic and a reflection characteristic of a cable to waveguide transition apparatus having a signal accumulation form of a backshort in accordance with a preferred embodiment of the present invention.

As shown in FIG. 12, the cable to waveguide transition apparatus of the present invention has a fundamental frequency characteristic at 20.5 GHz and maintains more than 5 GHz of 20 dB impedance bandwidth at an operation frequency band.

As mentioned above, the cable to waveguide transition apparatus includes the backshort 602 having the signal accumulation form which is the cylinder form. Therefore, distances from the RF probe 604 to any locations of the backshort 602 are maintained as λ/4 which is ¼ wavelength of the fundamental frequency signal. Therefore, a fundament frequency signal excited from the RF probe 604 and a fundament frequency signal reflected from the backshort 602 have identical phase. Accordingly, the excited fundamental frequency signal and the reflected fundament frequency signal are propagated to the aperture of the waveguide 601 while they have identical phase. Therefore, degradation of a transmission characteristic of the fundament frequency signal is prevented and the cable to waveguide transition apparatus can be reduced without considering the distance between the RF probe and the backshort. Furthermore, a 2-order harmonic frequency signal excited from the RF probe and a 2-order harmonic frequency signal reflected from the backshort have 180° phase difference. Therefore, they are interacted each other and thus, the 2-order harmonic frequency signal is eliminated.

Figure 13:
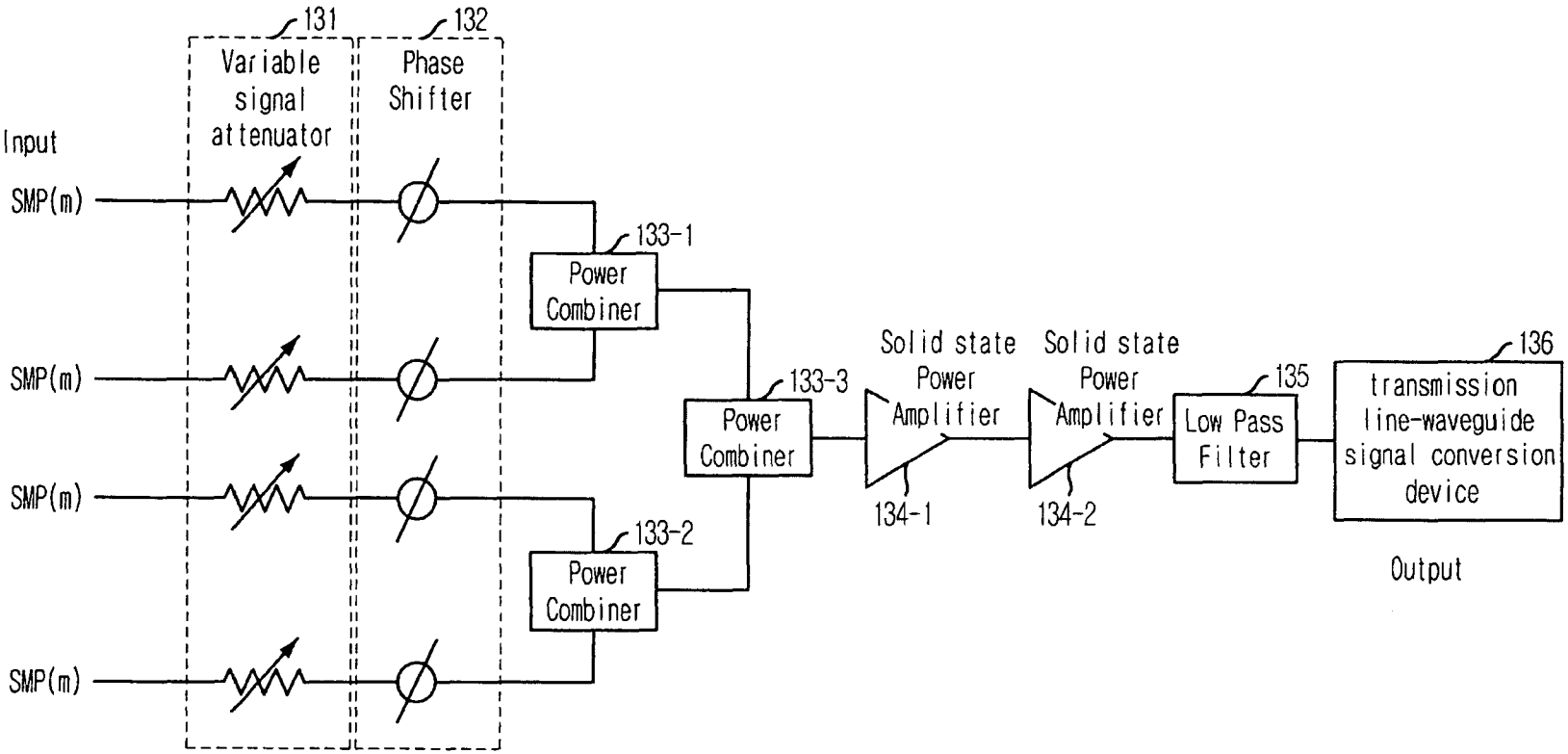
FIG. 13 is a diagram illustrating an active phase shifting system having the cable to waveguide transition having the signal accumulation form of the backshort apparatus of FIG. 6.

FIG. 13 is a diagram illustrating an active phase shifting system having the cable to waveguide transition having the signal accumulation form of the backshort apparatus of FIG. 6.

As shown in FIG. 13, the active phase shifting system (APM) includes a variable signal attenuator 131, a phase shifter 132, a power combiner 133, a solid state power amplifier 134, a low pass filter 135 and the cable to waveguide transition apparatus 136.

The active phase shifter system receives RF channel (beam) signals from a transmitting RF channel forming unit and independently processes a signal intensity and a phase of each RF channel signal. The active phase shifting system performs various functions including a function for controlling directions of electrical beam, a function for independently controlling beam, a function for controlling beam direction, a function for controlling a RF signal intensity, a function for combining a beam RF signal, a function for amplifying a signal in order to transmit the signal to an air and a function for emitting heat generated inside of the system to outside.

Also, sub modules of the active phase shifter system are controlled by an external controller. The phase shifter 132 is 5 bits digital type which controlling phase in 11.25° and the variable signal attenuator 131 has a resolution less than 0.5 dB.

Four signals outputted from the 5 bits phase sifter 132 have different gains at 4 ports. It is because characteristics of the 5 bits phase shifter 132 are different. Accordingly, external voltage is provided for making the gains of 4 ports to be identical. The variable signal attenuator 131 provide the external voltage to the 5 bits phase shifter 132 for making the gains identical.

The input RF signal is inputted to the 5 bit phase shifter (11.25°, 22.5°, 45°, 90°, 180°) from the SMP connector through the variable signal attenuator 131. The phase shifter 132 controls a beam direction (beam tilting) by controlling a phase of input beam according to an external control signal. The 4 input signals are combined to two signals by the 2-to-1 way signal combiners 133-1 and 133-2. The two combined signals are combined to one signal by the 2-to-1 way signal combiner 133-3. The combined signal is amplified by the solid stat power amplifiers 134-1 and 134-2. The amplified signal is filtered to eliminate RF noise signal by the low pass filter 135. The filtered signal is inputted to the cable to waveguide transition apparatus 136.

Figure 14:
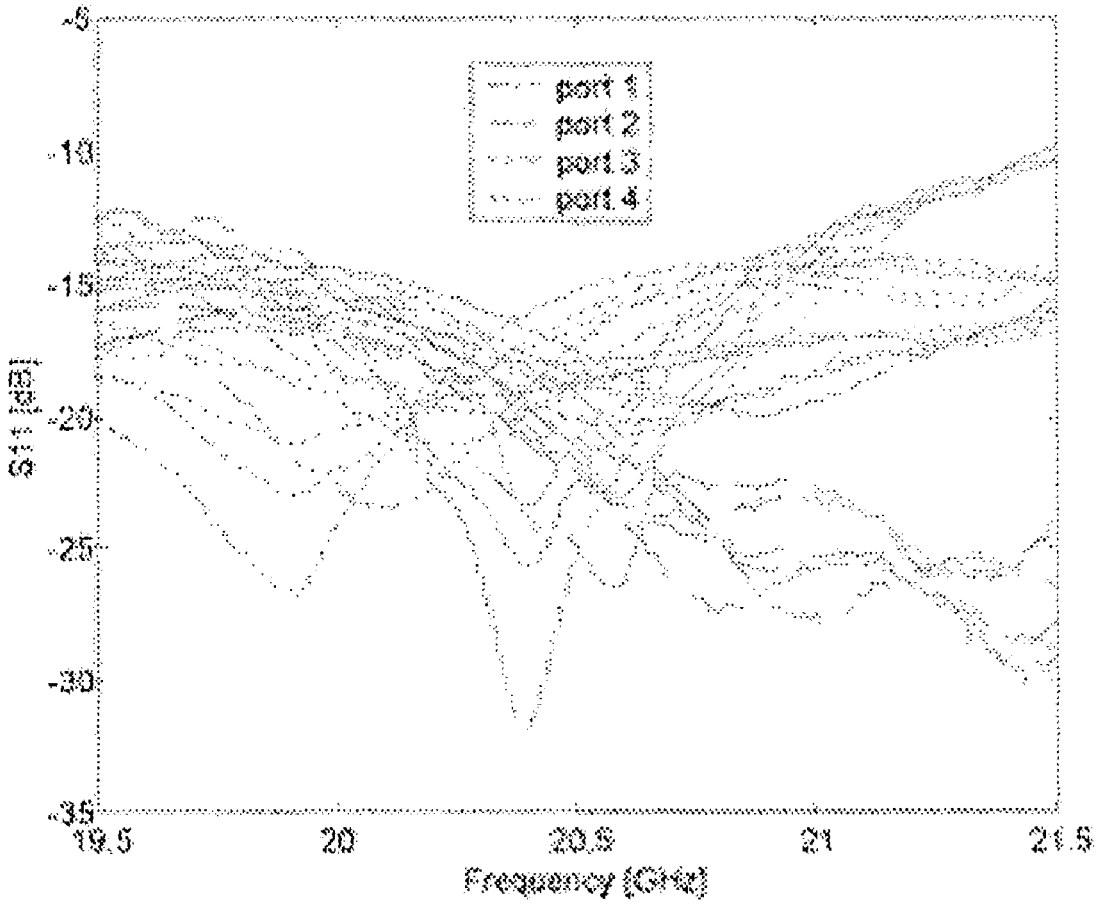
FIG. 14 is a graph showing a reflect loss of each port of the phase shifter 132 in FIG. 13.

FIG. 14 is a graph showing a reflect loss of each port of the phase shifter 132 in FIG. 13.

The graphs shows the reflect losses of each port when 5 bits of phase is applied to the phase shifter 132. As shown in FIG. 14, the reflect losses are less than −13 dB in 20 GHz to 21 GHz.

Figure 15:
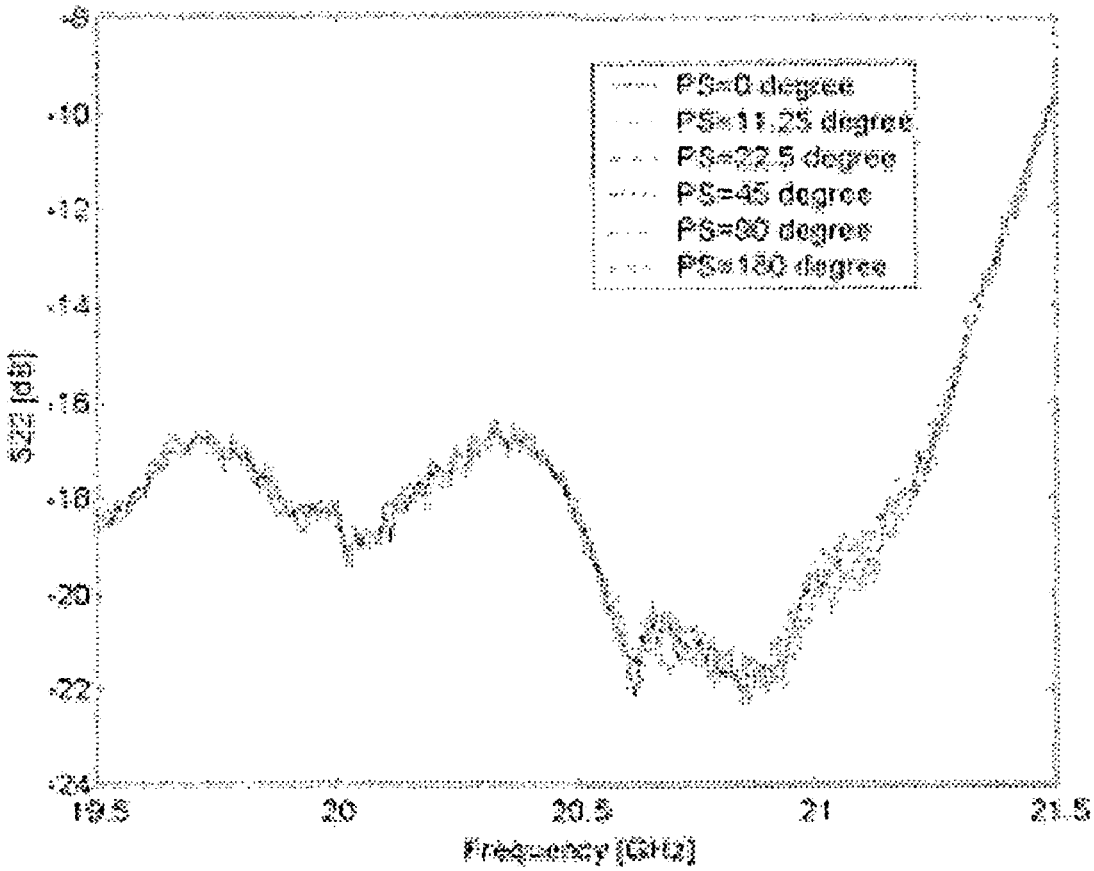
FIG. 15 is a graph showing a reflect loss of each output end.

FIG. 15 is a graph showing a reflect loss of each output end.

The graph shows the reflect losses of each output end when the phase shifter 132 converts the phase to 0°~180° according to a phase control signal.

Figure 16:
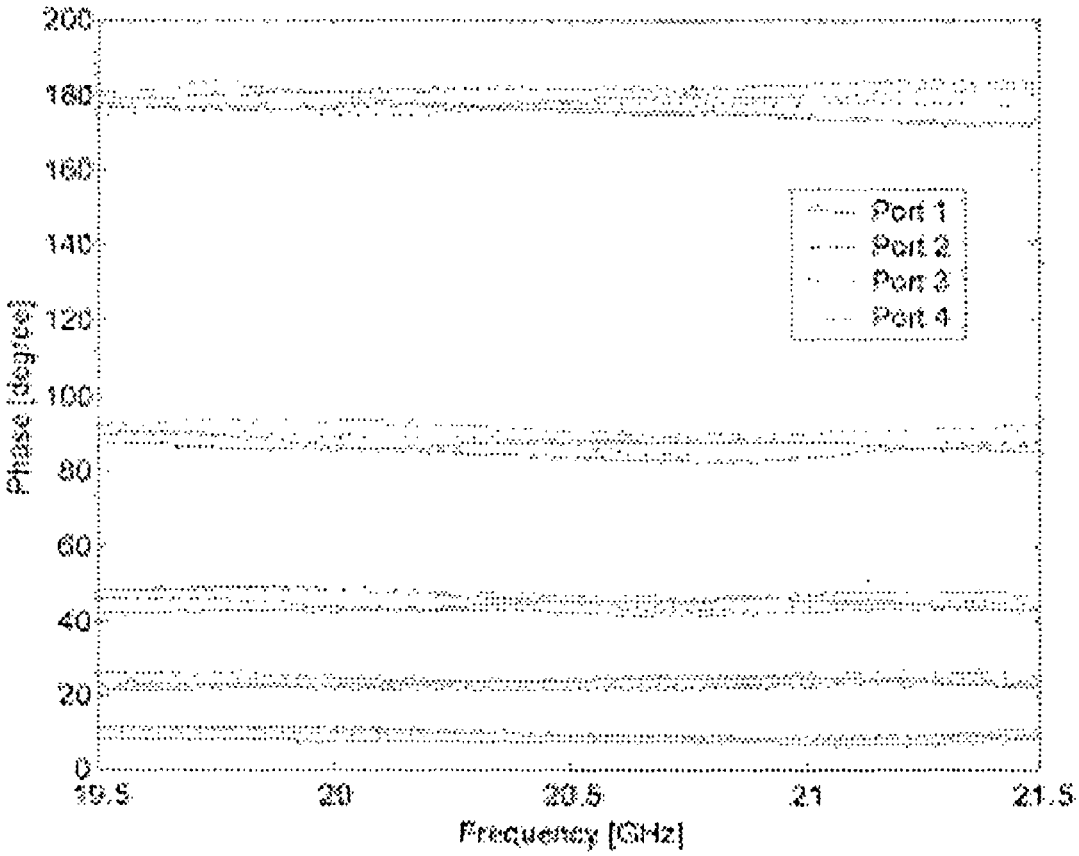
FIG. 16 is a graph showing a variation of a phase of each port.

FIG. 16 is a graph showing a variation of a phase of each port.

The graph shows the variation of the phase of each port when the phases of each port are converted to 11.25°, 22.5°, 45°, 90° and 180° respectively.

As mentioned above, the present invention can prevent degradation of transmission characteristic of fundamental frequency signal propagated to the aperture of the waveguide and can increase integration of the system by designing the backshort to be the signal accumulation form in order to reduce a distance between the RF probe and the backshort in the waveguide.

Also, by designing the backshort to be the cylinder form or the polygon form, the 2-order harmonic signal excited from the RF probe and the 2-order harmonic signal reflected from the backshort have 180° phase difference. Therefore, the present invention can effectively eliminate 2-order harmonic signal.

Furthermore, the present invention can prevent degradation of transmission characteristic of fundamental frequency signal, increase integration of the system and eliminate 2-order harmonic signal by implementing the cable to waveguide transition apparatus in the active phase shifting system.

While the present invention has been described with respect to certain preferred embodiments, it will be apparent to those skilled in the art that various changes and modifications may be made without departing from the spirits and scope of the invention as defined in the following claims.

What is claimed is:

1. A cable to waveguide transition apparatus having a signal accumulation form of a backshort, comprising:

a waveguide for propagating a signal;

a RF probe of a cable for transferring a radio frequency (RF) signal to the waveguide; and a backshort of the waveguide having the signal accumulation form for reflecting the RF signal excited from the RF probe to a location of the RF probe, wherein the backshort reflects a first fundamental frequency signal excited from the RF probe to have a phase identical to a phase of a second fundamental frequency signal excited from the RF probe to an aperture of the waveguide, and reflects a first 2-order harmonic frequency signal excited from the RF probe to have a phase reverse to a phase of a second 2-order harmonic frequency signal excited from the RF probe to an aperture of the waveguide in order to eliminate the 2-order harmonic frequency signal.

2. The cable to waveguide transition apparatus as recited in claim 1, wherein the signal accumulation form is a predetermined size of a cylinder form.

3. The cable to waveguide transition apparatus as recited in claim 1, wherein distances between the RF probe and any location of the backshort are $\lambda/4$ which is ¼ wavelength of a fundamental frequency signal in order to reflect a first fundamental frequency signal excited from the RF probe to have a phase identical to a phase of a second fundamental frequency signal excited from the RF probe to an aperture of the waveguide, and reflects a first 2-order harmonic frequency signal excited from the RF probe to have a phase reverse to a phase of a second 2-order harmonic frequency signal excited from the RF probe to an aperture of the waveguide in order to eliminate the 2-order harmonic frequency signal.

4. The cable to waveguide transition apparatus as recited in claim 1, wherein the backshort has a polygon form for accumulating the RF signals excited from the RF probe.

5. The cable to waveguide transition apparatus as recited in claim 4, wherein the backshort has a $\lambda/4$ of radius, where $\lambda$ is a wavelength of a signal.

6. An active phase shifting system, comprising:

controlling means for supplying a voltage to a radio frequency (RF) signal inputted to each port in order to make output gains of each port identical;

phase controlling means for controlling a direction of beam (beam tilting) by controlling a phase of the voltage controlled RF signal according to a control signal inputted to each port;

signal combining means for combining the phase controlled RF signals;

amplifying means for amplifying the combined signal;

filtering means for filtering noise of the amplified signal; and a wave guide having a signal accumulation form of a backshort reflecting a RF signal excited from a RF probe to a location of the RF probe for outputting the filtered signal, wherein the backshort reflects a first fundamental frequency signal excited from the RF probe to have a phase identical to a phase of a second fundamental frequency signal excited from the RF probe to an aperture of the waveguide, and reflects a first 2-order harmonic frequency signal excited from the RF probe to have a phase reverse to a phase of a second 2-order harmonic frequency signal excited from the RF probe to an aperture of the waveguide in order to eliminate the 2-order harmonic frequency signal.

7. The active phase shifting system as recited in claim 6, wherein the signal accumulation form has a predetermined size and distances between the RF probe and any location of the backshort are $\lambda/4$ which is ¼ wavelength of a fundamental frequency signal in order to reflect a first fundamental frequency signal excited from the RF probe to have a phase identical to a phase of a second fundamental frequency signal excited from the RF probe to an aperture of the waveguide, and reflects a first 2-order harmonic frequency signal excited from the RF probe to have a phase reverse to a phase of a second 2-order harmonic frequency signal excited from the RF probe to an aperture of the waveguide in order to eliminate the 2-order harmonic frequency signal.

* * * * *